United States Patent [19]

Bos et al.

[11] 4,053,277

[45] Oct. 11, 1977

[54] APPARATUS AND METHOD FOR HEATING THREADS

[75] Inventors: Cornelis Bos, Dieren; Jacobus J. H. G. Daamen, Arnhem, both of Netherlands

[73] Assignee: Akzona Incorporated, Asheville, N.C.

[21] Appl. No.: 720,496

[22] Filed: Sept. 3, 1976

[30] Foreign Application Priority Data

Sept. 5, 1975 Netherlands ..... 7510463

[51] Int. Cl.[2] ..... F27B 9/28

[52] U.S. Cl. ..... 432/60; 219/469; 165/89; 165/90; 308/9; 34/120; 34/124; 28/219; 28/281

[58] Field of Search ..... 432/59, 60, 8, 227, 432/228, 236; 219/469; 165/89, 90; 28/61, 62; 308/9; 34/119, 120, 124, 242

[56] References Cited

U.S. PATENT DOCUMENTS

| | | | |
|---|---|---|---|
| 2,066,127 | 12/1936 | Slayter | 219/325 |
| 3,232,680 | 2/1966 | Clark | 308/9 |
| 3,546,433 | 12/1970 | Johnson | 219/469 |
| 3,560,062 | 2/1971 | Kun et al. | 308/9 |
| 3,600,550 | 8/1971 | Katsumata | 219/469 |
| 3,879,594 | 4/1975 | Shillito | 219/469 |
| 3,922,752 | 12/1975 | Holm | 34/242 |

FOREIGN PATENT DOCUMENTS

| | | | |
|---|---|---|---|
| 1,544,792 | 11/1968 | France | 219/469 |

*Primary Examiner*—John J. Camby
*Assistant Examiner*—Henry C. Yuen
*Attorney, Agent, or Firm*—Francis W. Young; Tom R. Vestal

[57] ABSTRACT

Disclosed is an apparatus for heating high speed moving yarns by using a roller with a fixed core and a rotatable jacket separated from the core by a narrow gap. In operation, the gap is filled with a gas under superatmospheric pressure. A method for using the apparatus is also disclosed.

7 Claims, 3 Drawing Figures

APPARATUS AND METHOD FOR HEATING THREADS

BACKGROUND OF THE INVENTION

Heating of yarns by passing the yarns over a roller has been practiced in the art for some time. It has been known to provide various means of rotation for the rollers, including roller bearings, spindle bearings, point bearings of precious minerals, as well as forced air bearings.

It has also been known to provide a temperature gradient across the transverse face of a roller heater. Until the present invention, however, it has not been possible to spin polymers satisfactorily at high speeds — above 2000 meters per minute — and pass the spun product over a heated roller and obtain uniform results.

BRIEF DESCRIPTION OF THE PRESENT INVENTION

The present invention is directed to an apparatus for heating threads, synthetic yarns, ribbons, and like objects moving at high speeds and comprises a roller with a fixed core, having a rotatably supported jacket narrowly separated from the fixed core by a narrow gap which, in operation, is filled with a gas under superatmospheric pressure. The jacket is provided with a surface over which the threads, etc., may pass to absorb heat from the roller. The running surface transverse length preferably is substantially less than the total transverse length of the roller.

The roller may be utilized in various yarn treating processes such as combined spinning, drawing and winding (spin-draw-winding) or combined spinning, drawing, texturing, and winding (spin-draw-texturing). Of course, the roller may also be utilized in processes wherein any of the above steps may be separately conducted.

As mentioned, the running surface is preferably less than the total transverse length of the roller. The running surface should be less than 70% of the total length for normal heating operation, while running lengths of between 15% and 35% the total lengths may be especially useful for heating a portion of the cross section of a running thread to impart a latent crimp.

The running surface may be formed on a collar which projects radially from the remainder of the roller body, with thermal insulation being provided between the collar and the remainder of the body. Thermal insulation may be attached to the rotating jacket or to the fixed core.

The jacket and/or collar preferably is constructed of high heat conducting material such as electrolytically pure copper or silver. To prevent damage, in the case of air bearings, the fixed core may be made of polished stainless steel and a portion of the inner surface of the jacket next to the core may be provided with a bronze or aluminum bronze lining.

In a preferred embodiment, the heated jacket is supported by air pressure and is exclusively driven by a moving thread to be heated. In this embodiment, it is possible to operate the roller at speeds upward of 2000 to 6000 meters per minute and achieve uniform temperatures on the roller running surface of upwards of 200° to 450° C.

By contacting the roller with a running thread over an arc of such a length that a temperature gradient is created across the cross section of the thread, latent crimping characteristics may be imparted to the thread which may be developed in subsequent operations.

BRIEF DESCRIPTION OF THE DRAWINGS

In FIG. 1, a fixed core 1 on a stationary shaft 4 is fixedly mounted on a yarn or like treating machine (not shown). The shaft 4 is provided with a hollow space 2 which links with a hollow space 3 in the fixed core 1. An air supply 32 is connected by conventional means to shaft 14 in communication with hollow space 2. Channels 5 and 6 are spaced uniformly around fixed core 1 and transmit superatmospheric or compressed gas from the supply to an air gap 7 between the core 1 and jacket 10 to form an air bearing. Collar 11 on the jacket supports ring 12 which has a running surface 12*a*. Heating elements 15 are spaced uniformly around core 1, as shown in FIG. 2.

Figure 1:
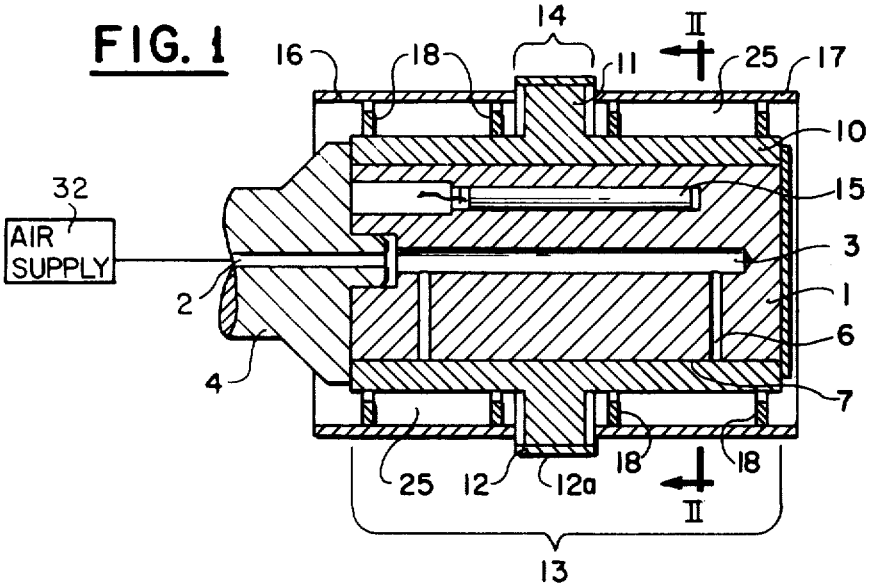
FIG. 1 is a longitudinal section of one embodiment of the invention.

In the embodiment of FIG. 1, the length 14 of running surface 12*a* is considerably shorter than the length 13 of fixed core 1. As mentioned, for latent crimping, the length 14 may be 15% to 35% of the core length 13.

Around the jacket 10, and on either side of collar 11 are provided heat insulating sleeves 16 and 17 which are each supported from the jacket 10 by two insulating support rings 18. More particularly shown in FIG. 2, the insulating support rings have inner tips 19, 20, and 21 which contact jacket 10 and outer tips 22, 23, and 24 which each support the insulating sleeves 16 and 17. This arrangement forms air pockets 25 between the sleeves and provides satisfactory thermal insulation to keep the temperature of the thermal insulating sleeves 16 and 17 considerably lower than the temperature of the jacket 10. The thermal insulation can be further improved by providing a labyrinth gland between the ambient air and air chamber 25.

Heat is transmitted from the heaters 15 through fixed core 1 and narrow air gap 7 to jacket 10 where it is then transmitted through collar 11 to ring 12 and running surface 12*a* to a moving thread contacting running surface 12*a*.

Figure 2:
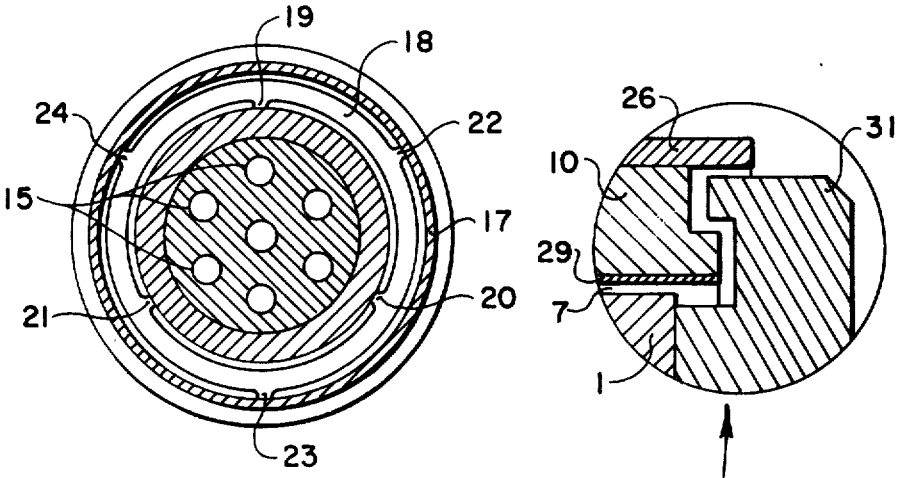
FIG. 2 is a cross section of FIG. 1 along line II–IV.
Figure 3:
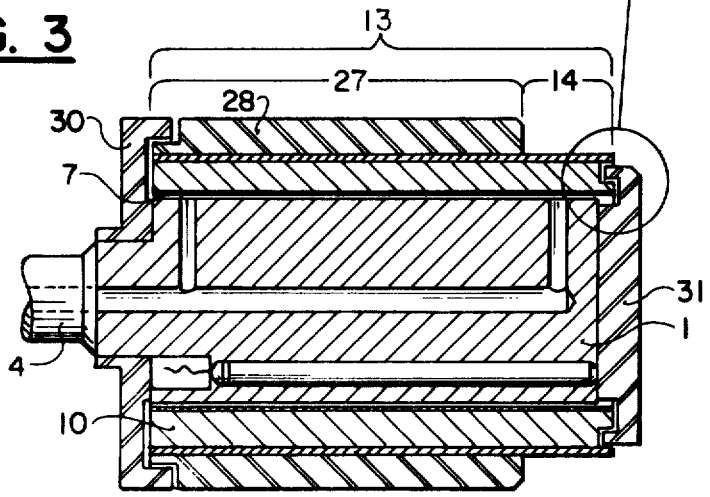
FIG. 3 is a longitudinal section of a second embodiment of the invention.

In FIG. 3, a second embodiment is described with like numerals referring to like parts in FIGS. 1 and 2. A fixed round core 1 supported on a shaft 4 as before has insulating caps 30 and 31 attached at both ends. A cylindrical jacket 10 having an inner surface slightly larger than the fixed core 1 is fitted over the core 1 and is supported in operation by compressed gas entering the gap 7 between the core 1 and jacket 10 through channels 3, 5, and 6 from a supply source.

A stainless steel bushing 26 is formed around jacket 10 and the portion 14 thereof acts as a yarn or thread contacting surface. A thermal insulating sleeve 28 surrounds the remainder portion 27 of bushing 26.

A thin layer 29 of aluminum bronze coats the inner surface of jacket 10 to provide a bearing surface in case of compressed gas failure, as shown in the blow-up portion of FIG. 3. Nominally, the air gap between the fixed core 1 and jacket 10 at ambient temperature is less than 0.1 mm.

The following table contains examples of the use of the present invention in a combined spin-draw-texturing process for polyester filament yarns composed of 30 filaments. In the process, polyester polymer is sequentially melted, spun into filaments, stretch-drawn, passed over the roll of the invention, passed over a cooling roll, then wound onto a take-up capstan. A latent crimp is imparted to the yarn while it is in contact with the roll of the invention.

TABLE

| Winding Speed in Meters/ Min. | Draw Ratio | Temperature Core of Hot Roll ° C | Temperature Surface of Hot Roll ° C | Residence Time on Hot Roll Mil.Sec. | Decitex | Tenacity CN/tex | % Elongation | Crimp 3 Min. in Hot Air 190° C. 1 g/tex |
|---|---|---|---|---|---|---|---|---|
| 3800 | 3.90 | 410° | 270° | 0.90 | 135 | 44.7 | 22.2 | 23.3 |
| 3500 | 4.00 | 400° | 285° | 0.90 | 133 | 42.2 | 22.7 | 23.4 |
| 3000 | 4.20 | 405° | 320° | 0.90 | 141 | 39.1 | 22.5 | 23.0 |
| 3000 | 4.15 | 385° | 270° | 1.14 | 139 | 40.2 | 22.6 | 22.1 |
| 3000 | 4.15 | 405° | 285° | 1.14 | 136 | 38.3 | 23.7 | 23.4 |
| 3000 | 4.15 | 405° | 285° | 1.30 | 135 | 43.2 | 24.8 | 20.4 |

The latent crimp in the yarns in Table I was developed by passing the yarn in a relaxed condition through a hot air box. The filaments were then cut into 3 cm. lengths and pretensioned one gram/decitex and placed in a slide. The slide with the pretensioned filament was then projected onto a screen and the number of crimps were counted therefrom.

Other embodiments may become apparent to those skilled in the art and the specification herein is not to be deemed as limiting the invention. The invention is set forth in the following claims.

What is claimed is:

1. An apparatus for heating threads comprising: a core fixedly mounted to a frame and having a cylindrical surface; a cylindrical jacket rotatably mounted over said core and separable by a narrow gap from said core, a portion of the jacket having thermal insulation means on its exterior surface, the remaining exterior surface being the running surface for the threads; means for heating the core; and means for supplying a compressed gas to the gap between the core and the jacket.

2. The apparatus of claim 1 wherein the running surface of the jacket is less than 70% of the transverse length of the jacket.

3. The apparatus of claim 1 wherein the running surface of the jacket is less than 70% of the transverse length of the jacket.

4. The apparatus of claim 1 wherein the running surface is between 15% and 35% of the transverse length of the jacket.

5. The apparatus of claim 1 wherein the running surface is on a raised collar of the jacket and the insulation means abut the raised collar.

6. The apparatus of claim 1 wherein the jacket is formed from a high heat conducting material selected from the group consisting essentially of electrolytically pure copper and silver.

7. The apparatus of claim 1 wherein the thermal insulation means compresses one or more rings having tips on the inner surfaces thereof substantially the same diameter as the fixed core and tips on the outer surface with a diameter greater than the nominal ring diameter; and a cylindrical sleeve whose inner diameter is substantially the same as the outer surface tips of the rings.

* * * * *